US007575668B1

(12) United States Patent
Nafis

(10) Patent No.: US 7,575,668 B1
(45) Date of Patent: Aug. 18, 2009

(54) CONVERSION OF KEROSENE TO PRODUCE NAPHTHA AND ISOBUTANE

(75) Inventor: Douglas A. Nafis, Mount Prospect, IL (US)

(73) Assignee: UOP LLC, Des Plaines, IL (US)

( * ) Notice: Subject to any disclaimer, the term of this patent is extended or adjusted under 35 U.S.C. 154(b) by 536 days.

(21) Appl. No.: 10/959,469

(22) Filed: Oct. 6, 2004

(51) Int. Cl.
*C10G 45/00* (2006.01)

(52) U.S. Cl. ..... 208/57

(58) Field of Classification Search ..... 208/57, 208/89, 130, 143, 49, 95, 58, 61
See application file for complete search history.

(56) References Cited

U.S. PATENT DOCUMENTS

| | | | | |
|---|---|---|---|---|
| 3,684,694 | A * | 8/1972 | Hanson et al. | 208/89 |
| 3,692,666 | A | 9/1972 | Pollitzer | 208/112 |
| 4,110,198 | A * | 8/1978 | Hayes et al. | 208/111.1 |
| 4,193,895 | A * | 3/1980 | Light et al. | 502/230 |
| 4,830,734 | A * | 5/1989 | Nagji et al. | 208/208 R |
| 6,210,561 | B1 * | 4/2001 | Bradow et al. | 208/89 |

* cited by examiner

*Primary Examiner*—Walter D Griffin
*Assistant Examiner*—Frank C Campanell
(74) *Attorney, Agent, or Firm*—James C Paschall

(57) ABSTRACT

A process for selective hydrocracking of kerosene to produce naphtha and isobutane.

18 Claims, 1 Drawing Sheet

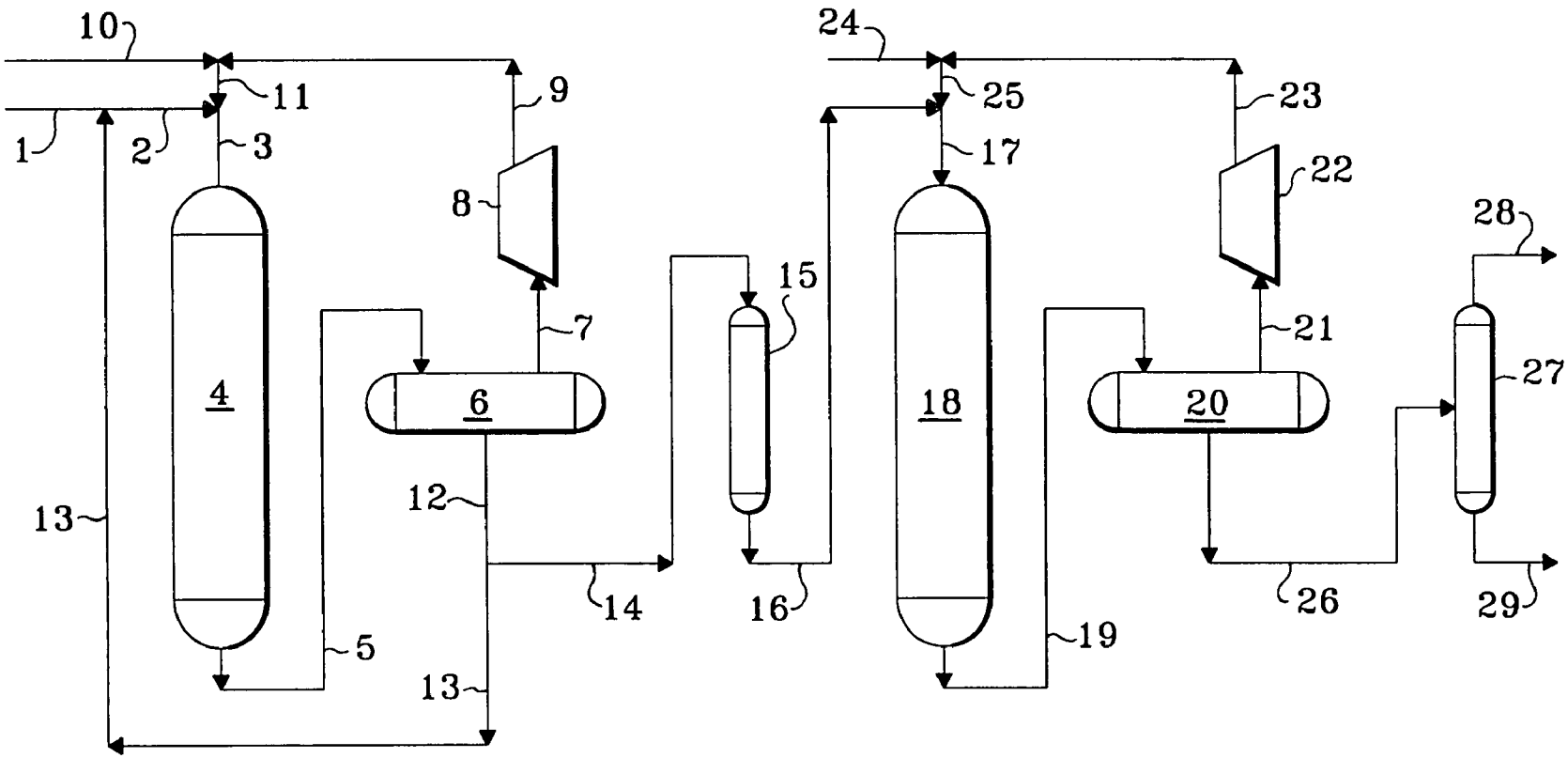
1
2
3
4
5
6
7
8
9
10
11
12
13
13
14
15
16
17
18
19
20
21
22
23
24
25
26
27
28
29

CONVERSION OF KEROSENE TO PRODUCE NAPHTHA AND ISOBUTANE

BACKGROUND OF THE INVENTION

This invention relates to the conversion of a kerosene feedstock to produce naphtha and isobutane.

In some markets for the sale of hydrocarbon products such as kerosene used for jet fuel and naphtha used in gasoline, there is an imbalance in supply and demand. When there is a surplus of kerosene and a shortfall of naphtha, there is a need for an economical and selective process to convert kerosene to naphtha and isobutane. In accordance with the present invention, a kerosene boiling range hydrocarbon feedstock may be converted to naphtha in a low-pressure, low severity catalytic hydrocracking process.

INFORMATION DISCLOSURE

U.S. Pat. No. 3,692,666 (Pollitzer) discloses a hydrocracking process to produce lower-boiling hydrocarbon products using a Friedel-Crafts metal halide-free catalytic composite containing platinum and the reaction product of alumina and sublimed aluminum chloride.

BRIEF SUMMARY OF THE INVENTION

The present invention relates to a process for the conversion of a kerosene boiling range feedstock to produce naphtha and isobutane wherein the kerosene feedstock and hydrogen are reacted in an aromatic saturation reaction zone containing a noble metal catalyst to produce a liquid hydrocarbon stream having a reduced concentration of aromatic compounds. Aromatic compounds are saturated and simultaneously the sulfur and oxygen containing compounds are reacted to produce hydrogen sulfide and water. Since the hydrocracking catalyst utilized in the present invention is sensitive to and poisoned by the presence of water and hydrogen sulfide, at least a portion of the resulting hydrocarbon effluent from the aromatic saturation reaction zone is introduced into an adsorption zone containing an adsorbent to remove the water and hydrogen sulfide from the hydrocarbon stream. The resulting hydrocarbon stream containing essentially no water or hydrogen sulfide is then reacted with hydrogen in a hydrocracking zone containing a noble metal on chlorided alumina hydrocracking catalyst to produce naphtha and isobutane.

The key to handling the high heat of reaction is to separate the aromatics saturation reaction, which can benefit from liquid recycle without a selectivity penalty, from the hydrocracking reactions. The key to being able to handle the thiophenic feed sulfur is to operate the aromatic saturation reaction zone at relatively high temperatures whereby the resulting hydrogen sulfide can be continuously stripped or removed from the aromatic saturation catalyst to prevent deactivation. The high temperature desulfurization and aromatic saturation must be accomplished in a separate reaction zone to protect the highly sulfur-sensitive hydrocracking catalyst from deactivation by hydrogen sulfide and to permit the hydrocracking reaction zone to operate at a lower temperature which favors the desired selectivity to the desired naphtha and isobutane products.

Other embodiments of the present invention encompass further details such as feedstock characteristics, aromatic saturation catalysts, adsorbents, hydrocracking catalysts and operating conditions, all of which are hereinafter disclosed in the following discussion of each of the facets of the invention.

BRIEF DESCRIPTION OF THE DRAWING

The drawing is a simplified schematic flow diagram of a preferred embodiment of the present invention.

DETAILED DESCRIPTION OF THE INVENTION

The present invention provides a process for the conversion of a kerosene feedstock to produce naphtha and isobutane. The process selectively shifts the boiling range downward by about four carbon numbers while simultaneously producing isobutane with minimal $C_3$— production. The isobutane product may be used as an alkylation feedstock to produce desirable blending components for gasoline.

The kerosene boiling range feedstock preferably boils in the range from about 85° C. (185° F.) to about 332° C. (630° F.) and contains less than about 5 wppm sulfur and more preferably less than about 1 wpm sulfur and more preferably boils in the range from about 149° C. (300° F.) to about 271° C. (520° F.) and contains less than about 5 wppm sulfur and more preferably less than about 1 wppm sulfur. The kerosene feedstock may be obtained in any convenient manner from crude oil and any other source. A suitable kerosene feedstock may be from a crude oil fractionator, a hydrotreater effluent or a kerosene product stream from a hydrocracker. In accordance with the process of the present invention a kerosene feedstock and hydrogen are reacted in an aromatic saturation reaction zone containing a noble metal catalyst to produce a liquid hydrocarbon stream having a reduced concentration of aromatic compounds. In addition, heteroatom compounds containing sulfur and oxygen are also reacted to produce water and hydrogen sulfide.

The noble metal catalyst utilized in the aromatic saturation reaction zone may be any suitable catalyst containing a Group VIII noble metal which selectively saturates aromatic hydrocarbon compounds. Group VIII noble metal components may be selected from the group consisting of platinum, palladium, rhodium, ruthenium, osmium and indium. The noble metal component is preferably supported on a convenient support material which includes for example alumina, silica, silica-alumina and zirconia. In accordance with the present invention, a preferred aromatic saturation catalyst contains platinum and alumina.

The aromatic saturation zone is preferably operated at conditions including a temperature from about 250° C. (482° F.) to about 350° C. (662° F.), a pressure from about 3.2 MPa (450 psig) to about 5.3 MPa (750 psig) and a hydrogen circulation rate from about 422 $nm^3/m^3$ (2500 standard cubic feet per barrel) to about 1264 $nm^3/m^3$ (7500 standard cubic feet per barrel). A temperature and a hydrogen circulation rate are preferably selected to permit the catalyst to operate without significant deactivation of the noble metal function. In one embodiment of the present invention, at least a portion of the resulting liquid hydrocarbon stream having a reduced concentration of aromatic compounds is recycled to the feed inlet of the aromatic saturation reaction zone to dilute the feed aromatic compounds and to thereby provide sufficient quench to control the exothermic temperature rise from the aromatic compound saturation reaction. The recycle rate may be conveniently selected depending upon the level and concentration of aromatic compounds in the fresh feedstock and the degree of temperature rise which can be accommodated in the aromatic saturation reaction zone.

The balance of the resulting liquid hydrocarbonaceous stream having a reduced concentration of aromatic compounds and containing small amounts of hydrogen sulfide and water is introduced into an adsorption zone containing an adsorbent which selectively adsorbs water and hydrogen sulfide to prepare the hydrocarbonaceous stream for the subsequent hydrocracking step. Any suitable adsorbent may be selected to be loaded into the adsorbent zone which demonstrates the ability to selectively remove water and hydrogen sulfide from the hydrocarbonaceous stream. Preferred adsorbents may be selected from the group consisting of zeolite A, zeolite X and promoted alumina. A particularly preferred adsorbent is a 4A zeolite.

The adsorption zone is preferably operated at a temperature from about 4.4° C. (40° F.) to about 65° C. (150° F.) and a pressure from about 1.5 MPa (200 psig) to about 5.3 MPa (750 psig). The adsorbent is preferably loaded into the adsorbent zone in one or more fixed beds for subsequent contact with the hydrocarbonaceous stream.

A hydrocarbonaceous stream having a reduced concentration of aromatic compounds is removed from the adsorption zone and introduced along with hydrogen into a hydrocracking zone containing a noble metal on chlorided alumina hydrocracking catalyst to produce naphtha and isobutane.

Suitable alumina carrier materials for the hydrocracking catalyst have an apparent bulk density of about 0.30 to about 0.70 gm./cc., and surface area characteristics indicating an average pore diameter of about 20 to about 300 Angstroms, a pore volume of about 0.10 to about 1.0 milliliters per gram and a surface area of about 100 to about 500 square meters per gram. The carrier material may be prepared in any suitable manner, none being essential to the invention, and may be activated prior to use by one or more treatments including drying, calcination, steaming, etc. For example, the amorphous carrier may be prepared by adding a suitable alkaline reagent, such as aluminum chloride, aluminum nitrate, etc., in an amount to form a hydroxide gel which, upon drying and calcination is converted into alumina. This may be formed in any desired shape including spheres, pills, cakes, extrudates, powders, granules, etc., and may further be utilized in any desired size.

The selective hydrocracking catalyst for use in the process of the present invention contains a Group VIII noble metal component. Thus, suitable metals are those of the group including platinum, palladium, rhodium, ruthenium, osmium and iridium. A particularly preferred catalytic composite contains a platinum component. The Group VIII metal component, for example platinum, may exist within the final composite as a compound such as an oxide, sulfide, halide, etc., or in an elemental state. Generally the amount of the noble metal component is small compared to the quantities of the other components combined therewith. Calculated on an elemental basis, the noble metal component generally comprises from about 0.1% to about 2.0% by weight of the final composite.

These components may be incorporated within the catalytic composite in any suitable manner including co-precipitation or co-gellation with the carrier material, ion-exchange, or impregnation. The latter constitutes a preferred method of preparation, utilizing water-soluble compounds of the metallic components. Thus, the platinum component may be added to the carrier material by commingling the latter with an aqueous solution of chloroplatinic acid. Other water-soluble compounds may be employed, and include ammonium chloroplatinate, platinum chloride and dinitro-diamino platinum. It is generally preferred to impregnate the carrier material after it has been calcined in order to minimize the risk of losing the valuable noble metal compounds. Following impregnation, the carrier material is dried and subjected to calcination or oxidation and generally followed by reduction in hydrogen at elevated temperature.

Briefly, therefore, the preferred technique involves the incorporation of the Friedel-Crafts metal halide after the catalytically active metal components have been impregnated onto the carrier material, and following drying and calcination, and reduction in hydrogen. Where the sublimation technique is utilized to prepare the catalyst, with the alumina carrier material, the metal halide will be vaporized onto the carrier, and the same heated to a temperature above about 300° C., and for a time sufficient to remove any unreacted metal halide. Thus, the final catalytic composite does not contain any free Friedel-Crafts metal halides. The refractory oxide, following vaporization of the Friedel-Crafts metal halide, and heating of the thus-formed composite, will be increased in weight by from about 2% to about 25% based upon the original weight of the refractory oxide carrier material. While the exact increase in weight does not appear to be critical, high activity catalysts are obtained when the thus-treated refractory material has been increased in weight from about 5% to about 20%. On the basis of the quantity of the metal halide combined therewith, the treated carrier material will preferably contain from about 2% to about 20% by weight of the metal halide, and preferably from about 4% to about 17% by weight, as the metal halide.

Since the group, —Al—O—$AlCl_2$, is extremely moisture sensitive, the sublimation technique is performed after the Group VIII metal component has been combined with the alumina.

Various Friedel-Crafts metal halides may be utilized, but not necessarily with equivalent results. Examples of such metal halides include aluminum bromide, alumina chloride, antimony pentachloride, beryllium chloride, ferric bromide, ferric chloride, gallium trichloride, stannic bromide, stannic chloride, titanium tetrabromide, titanium tetrachloride, zinc bromide, zinc chloride, and zirconium chloride. The Friedel-Crafts aluminum halides are preferred with aluminum chloride and/or aluminum fluoride being particularly preferred. This is so, not only due to the ease of preparation, but also because the thus-prepared catalyst have high activity.

The temperature at which the Friedel-Crafts metal halide is vaporized onto the alumina, will vary in accordance with the particular Friedel-Crafts metal halide utilized. In most instances, the vaporization is carried out either at the boiling point or sublimation point of the particular Friedel-Crafts metal halide, or at a temperature not greatly exceeding these points; for example, not greater than 100° C. higher than the boiling point, or sublimation point. In effecting one catalyst preparation, the amorphous carrier material has aluminum chloride sublimed thereupon. Aluminum chloride sublimes at 178° C., and thus a suitable vaporization temperate will range from about 180° C. to about 275° C. The sublimation can be carried out under pressure, and also in the presence of diluents such as inert gases.

Although the particularly preferred technique involves the sublimation of a metal halide directly to react with the alumina, the reaction product can result from a halide-containing compound with initially reacts with the alumina to form an aluminum halide which, in turn, reacts with additional alumina, thereby forming groups of —Al—OAl—$Cl_2$, etc. Such halide containing compounds include $CCl_4$, $SCl_2$, $SOCl_2$, etc.

Prior to its use, the catalytic composite may be subjected to a substantially water-free reduction technique. This is designed to insure a uniform and finely-divided dispersion of the metallic components throughout the carrier material. Preferably, substantially pure and dry hydrogen is employed as the reducing agent. The catalyst is contacted at a temperature of about 426° C. (800° F.) to about 648° C. (1200° F.), and for a period of time from 0.5 to about 10 hours, to substantially reduce the metallic components.

According to the present invention, the hydrocarbonaceous stream and hydrogen are contacted with a catalyst of the type hereinabove described in a hydrocracking zone. The contacting may be accomplished by using the catalyst in a fixed-bed system, a moving-bed system, a fluidized-type bed system or in a batch type operation; however, in view of the risk of attrition loss of the valuable catalyst, it is preferred to use the fixed-bed system. In the fixed bed type of system, a hydrogen-rich gas and the charge stock are preheated by any suitable heating means to the desired reaction temperature, and are then passed into the hydrocracking conversion zone containing the fixed bed of the catalytic composite. It is understood, of course, that the hydrocracking conversion zone may be one or more separate reactors having suitable means therebetween to insure that the desired conversion temperature is maintained at the entrance to each reactor. The reactants may be contacted by the catalyst bed in either upward, downward, or radial flow fashion. Additionally, the reactants may be in the liquid phase or a mixed liquid-vapor phase when contacting the catalyst.

In view of the fact that the hydrocracking reactions being effected are exothermic in nature, an increasing temperature gradient is experienced as the hydrogen and hydrocarbons traverse the catalyst bed. In accordance with the present invention, the maximum catalyst bed temperature is preferably in the range of about 177° C. (350° F.) to about 343° C. (650° F.). In order to assure the catalyst bed temperature does not exceed the maximum allowable, the use of conventional quench streams, either normally liquid, or normally gaseous, introduced at one or more intermediate loci of the catalyst bed, may be utilized. The hydrocracking reaction zone is preferably maintained at a pressure from about 1.5 MPa (200 psig) to about 5.3 MPa (750 psig).

DETAILED DESCRIPTION OF THE DRAWING

In the drawing, the process of the present invention is illustrated by means of a simplified schematic flow diagram in which such details as pumps, instrumentation, heat-exchange and heat-recovery circuits, compressors and similar hardware have been deleted as being non-essential to an understanding of the techniques involved. The use of such miscellaneous equipment is well within the purview of one skilled in the art.

Referring now to the drawing, a kerosene feedstock is introduced into the process via line 1 and is admixed with a hereinafter described liquid hydrocarbon recycle stream provided by line 13 and the resulting admixture is carried via line 2 and admixed with a hydrogen-rich recycle gas provided via line 11 and the resulting admixture is carried via line 3 and introduced into aromatic saturation reactor 4. A resulting effluent from aromatic saturation reactor 4 is carried via line 5, partially condensed and introduced into high pressure separator 6. A hydrogen-rich gaseous stream is removed from high pressure separator 6 via line 7 and introduced into compressor 8. A resulting compressed hydrogen-rich gaseous stream is removed from compressor 8 via line 9 and is admixed with a fresh makeup hydrogen stream introduced via line 10 and the resulting admixture is carried via lines 11 and 3 and introduced into aromatic saturation reactor 4 as hereinabove described. A liquid hydrocarbon stream having a reduced concentration of aromatic compounds and containing water and hydrogen sulfide is removed from high pressure separator 6 via line 12 and a first portion is carried via line 13 to provide a liquid recycle hydrocarbon stream as hereinabove described. Another portion is carried via line 14 and introduced into adsorption zone 15. A resulting hydrocarbonaceous stream having a reduced concentration of water and hydrogen sulfide is removed from adsorption zone 15 via line 16 and is admixed with a hydrogen-rich gaseous stream provided via line 25 and the resulting admixture is carried via line 17 and introduced into hydrocracking zone 18. A resulting hydrocracked hydrocarbon stream is removed from hydrocracking zone 18 via line 19, partially condensed and introduced into high pressure separator 20. A hydrogen-rich gaseous stream is removed from high pressure separator 20 via line 21 and introduced into compressor 22. A resulting compressed hydrogen-rich gaseous stream is removed from compressor 22 via line 23 and admixed with a hydrogen makeup gaseous stream provided via line 24 and the resulting admixture is carried via lines 25 and 17 and introduced into hydrocracking zone 18 as hereinabove described. A resulting liquid stream is removed from high pressure separator 20 via line 26 and introduced into fractionation zone 27. A stream containing isobutane is removed from fractionation zone 27 via line 28 and recovered. A liquid hydrocarbon stream containing naphtha is removed from fractionation zone 27 via line 29 and recovered.

The process of the present invention is further demonstrated by the following example. This example is, however, not presented to unduly limit the process of this invention, but to further illustrate the advantage of the hereinabove-described embodiment.

EXAMPLE

A kerosene stream from a hydrocracker in an amount of 100 mass units (MU) and having the characteristics presented in Table 1 was introduced together with a liquid hydrocarbonaceous recycle stream in an amount of 200 mass units and hydrogen into an aromatic saturation reaction zone containing an aromatic saturation catalyst containing platinum on an alumina support. The aromatic saturation reaction zone was operated at a pressure of 4.6 MPa (650 psig) and a catalyst peak temperature of 280° C. (536° F.).

The resulting liquid hydrocarbonaceous stream recovered from the aromatic saturation zone was found to contain 2.5 mass units of aromatic compounds.

TABLE 1

| Kerosene Feedstock Analysis | |
|---|---|
| Density, g/cc | 0.8253 |
| Distillation, ° C. (° F.) | |
| IBP | 152 (305) |
| 50% | 174 (345) |
| 90% | 200 (392) |
| 95% | 207 (406) |
| EP | 223 (434) |
| Sulfur, wppm | 1 |
| Nitrogen, wppm | <1 |
| Aromatic Oxygenates, wppm | 135 |
| Aromatics, weight percent | 43.4 |

This resulting liquid hydrocarbonaceous stream was contacted with an adsorbent containing 4A mole sieve in an adsorption zone operated at a temperature of 27° C. (80° F.) and a pressure of 3.2 MPa (450 psig) to remove essentially all of the water and hydrogen sulfide.

A resulting liquid hydrocarbonaceous stream having a reduced concentration of aromatic compounds and containing essentially no water or hydrogen sulfide was recovered from the adsorption zone and introduced into a hydrocracking zone containing platinum on chlorided alumina hydrocracking catalyst operated at a temperature of 208° C. (406° F.) and a pressure of 3.2 MPa (450 psig). The resulting product from the hydrocracking zone was recovered and contained 0.5 mass units of methane and ethane, 21.3 mass units of isobutane, 5 mass units of other normally gaseous hydrocarbons and 77.1 mass units of liquid naphtha boiling in the range of 42° C. (108° F.) and 171° C. (340° F.). The Example demonstrates the ability of the present invention to selectively convert a kerosene feedstock into a very high yield of naphtha and isobutane while producing exceedingly low quantities of undesirable other normally gaseous hydrocarbons.

The foregoing description, drawing and illustrative embodiment clearly illustrate the advantages encompassed by the process of the present invention and the benefits to be afforded with the use thereof.

What is claimed is:

1. A process for the conversion of a kerosene feedstock to produce naphtha and isobutane which process comprises:

(a) reacting the kerosene feedstock and hydrogen in an aromatic saturation reaction zone containing a noble metal catalyst to produce a liquid hydrocarbon stream having a reduced concentration of aromatic compounds;

(b) recycling at least a portion of the liquid hydrocarbon having a reduced concentration of aromatic compounds to the aromatic saturation reaction zone;

(c) passing at least a portion of the liquid hydrocarbon stream having a reduced concentration of aromatic compounds into an adsorption zone containing an adsorbent to remove hydrogen sulfide and water; and (d) reacting a resulting dry hydrocarbon stream produced in step (c) and hydrogen in a hydrocracking zone containing a noble metal on chlorided alumina hydrocracking catalyst to produce naphtha and isobutane.

2. The process of claim 1 wherein the kerosene feedstock boils in the range from about 85° C. (185° F.) to about 332° C. (630° F.).

3. The process of claim 1 wherein the kerosene feedstock contains less than about 5 wppm sulfur.

4. The process of claim 1 wherein the noble metal catalyst in step (a) comprises a metal from the group consisting of platinum and palladium.

5. The process of claim 1 wherein the adsorbent is selected from the group consisting of zeolite A, zeolite X and promoted alumina.

6. The process of claim 1 wherein the aromatic saturation zone is operated at conditions including a pressure from about 3.2 MPa (450 psig) to about 5.3 MPa (750 psig) and a temperature from about 250° C. (482° F.) to about 350° C. (662° F.).

7. The process of claim 1 wherein the hydrocracking zone is operated at conditions including a pressure from about 1.5 MPa (200 psig) to about 5.3 MPa (750 psig) and a temperature from about 177° C. (350° F.) to about 343° C. (650° F.).

8. The process of claim 1 wherein the hydrocracking catalyst in step (c) comprises a metal from the group consisting of platinum and palladium.

9. A process for the conversion of a kerosene feedstock to produce naphtha and isobutane which process comprises:

(a) reacting the kerosene feedstock consisting essentially of material having a boiling range from about 85° C. (185° F.) to about 332° C. (630° F.) and hydrogen in an aromatic saturation zone containing a noble metal catalyst containing platinum or palladium to produce a liquid hydrocarbon stream having a reduced concentration of aromatic compounds;

(b) passing at least a portion of the liquid hydrocarbon stream having a reduced concentration of aromatic compounds into an adsorption zone containing an adsorbent to remove hydrogen sulfide and water; and (c) reacting a resulting dry hydrocarbon stream produced in step (b) and hydrogen in a hydrocracking zone containing platinum or palladium on chlorided alumina hydrocracking catalyst to produce naphtha and isobutane.

10. The process of claim 9 wherein at least a portion of the liquid hydrocarbon having a reduced concentration of aromatic compounds is recycled to the aromatic saturation reaction zone.

11. The process of claim 9 wherein the kerosene feedstock contains less than about 5 wppm sulfur.

12. The process of claim 9 wherein the adsorbent is selected from the group consisting of zeolite A, zeolite X and promoted alumina.

13. The process of claim 9 wherein the aromatic saturation zone is operated at conditions including a pressure from about 3.2 MPa (450 psig) to about 5.3 MPa (750 psig) and a temperature from about 250° C. (482° F.) to about 350° C. (662° F.).

14. The process of claim 9 wherein the hydrocracking zone is operated at conditions including a pressure from about 1.5 MPa (200 psig) to about 5.3 MPa (750 psig) and a temperature from about 177° C. (350° F.) to about 343° C. (650° F.).

15. A process for the conversion of a kerosene feedstock to produce naphtha and isobutane which process comprises:

(a) reacting the kerosene feedstock having a boiling range from about 85° C. (185° F.) to about 332° C. (630° F.) and hydrogen in an aromatic saturation zone containing a noble metal catalyst containing platinum or palladium and operated at conditions including a pressure from about 3.2 MPa (450 psig) to about 5.3 MPa (750 psig) and a temperature from about 250° C. (482° F.) to about 350° C. (662° F.) to produce a liquid hydrocarbon stream having a reduced concentration of aromatic compounds;

(b) passing at least a portion of the liquid hydrocarbon stream having a reduced concentration of aromatic compounds into an adsorption zone containing an adsorbent to remove hydrogen sulfide and water; and (c) reacting a resulting dry hydrocarbon stream produced in step (b) and hydrogen in a hydrocracking zone containing platinum or palladium on chlorided alumina hydrocracking catalyst and operated at conditions including a pressure from about 1.5 MPa (200 psig) to about 5.3 MPa (750 psig) and a temperature from about 250° C. (482° F.) to about 350° C. (662° F.) to produce naphtha and isobutane.

16. The process of claim 15 wherein at least a portion of the liquid hydrocarbon having a reduced concentration of aromatic compounds is recycled to the aromatic saturation reaction zone.

17. The process of claim 15 wherein the kerosene feedstock contains less than about 5 wppm sulfur.

18. The process of claim 15 wherein the adsorbent is selected from the group consisting of zeolite A, zeolite X and promoted alumina.

* * * * *

UNITED STATES PATENT AND TRADEMARK OFFICE

CERTIFICATE OF CORRECTION

PATENT NO. : 7,575,668 B1
APPLICATION NO. : 10/959469
DATED : August 18, 2009
INVENTOR(S) : Douglas A. Nafis It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 751 days.

Signed and Sealed this

Seventh Day of September, 2010

David J. Kappos

David J. Kappos
*Director of the United States Patent and Trademark Office*